United States Patent [19]

Nitta

[11] Patent Number: 4,778,380

[45] Date of Patent: Oct. 18, 1988

[54] ROD-SHAPED GAS IGNITER

[75] Inventor: Tomio Nitta, Yokohama, Japan

[73] Assignee: Tokai Corporation, Kanagawa, Japan

[21] Appl. No.: 90,061

[22] Filed: Aug. 27, 1987

[30] Foreign Application Priority Data

Sep. 11, 1986 [JP] Japan ..... 61-138603[U]

[51] Int. Cl.[4] ..... F23Q 7/12

[52] U.S. Cl. ..... 431/255

[58] Field of Search ..... 431/255, 132

[56] References Cited

U.S. PATENT DOCUMENTS 4,538,983 9/1985 Zeller et al. ..... 431/255

FOREIGN PATENT DOCUMENTS 2557115 6/1976 Fed. Rep. of Germany ..... 431/255

*Primary Examiner*—Carroll B. Dority, Jr.

*Attorney, Agent, or Firm*—Armstrong, Nikaido, Marmelstein & Kubovcik

[57] ABSTRACT

Disclosed is a rod-shaped gas igniter including an ignition nozzle, a finger-operative piezoelectric generator, a liquefied gas reservoir, means responsive to the operation of the piezoelectric generator for opening valve means associated with the liquefied gas reservoir, thereby permitting gas to flow to the ignition nozzle, an inner protecting hollow cylinder having longitudinal slots circumferentially spaced for ventilation and enclosing the ignition nozzle, and an outer metal hollow cylinder having longitudinal holes circumferentially spaced for ventilation and encircling the protecting hollow cylinder, the longitudinal slots and holes of the inner and outer hollow cylinders being staggered to each other. The staggering arrangement of slots and holes in the inner and outer hollow cylinders is effective to prevent direct invasion by air from the longitudinal holes of the outer hollow cylinder to the ignition nozzle, permitting the air to leave entrained dust and impurities on the slot adjoining portions of the inside hollow cylinder. Thus, dust-free air is supplied to the ignition nozzle.

4 Claims, 3 Drawing Sheets

ROD-SHAPED GAS IGNITER

BACKGROUND OF THE INVENTION

1. Field of the Invention

The present invention relates to a rod-shaped gas igniter whose ignition nozzle is elongated from the igniter body to make it easy to have access to an object to be ignited.

2. Related Art

A conventional rod-shaped gas igniter has an ignition nozzle encircled by an apertured metal hollow cylinder, permitting the invasion by air through the longitudinal holes of the protecting hollow cylinder. In igniting with such rod-shaped gas igniter air flows directly to the ignition nozzle through the longitudinal holes of the protecting hollow cylinder. Then, the gas ejection apertures of the ignition nozzle are easy to be clogged with dust and impurities carried by the air, and they will be closed and the igniter will be useless in a relatively short time.

SUMMARY OF THE INVENTION

In view of the above, one object of the present invention is to provide a rod-shaped gas igniter which prevents accumulation of dust and impurities enough to close the gas ejection apertures of the injection nozzle, thereby assuring an extended use of the gas igniter.

To attain this object, a rod-shaped gas igniter including, in a casing, an ignition nozzle, a finger-operative piezoelectric generator, a liquefied gas reservoir, means responsive to the operation of the piezoelectric generator for opening valve means associated with the liquefied gas reservoir, thereby permitting gas to flow to the ignition nozzle, is improved according to the present invention in that it further includes an inner protecting hollow cylinder having longitudinal open slots circumferentially spaced for ventilation and enclosing the ignition nozzle fixed to the top elongation of the casing, and an outer metal hollow cylinder having longitudinal holes circumferentially spaced for ventilation and encircling the protecting hollow cylinder, the longitudinal open slots of the inner hollow cylinder and the longitudinal holes of the outer hollow cylinder being staggered to each other, thereby preventing direct invasion from the longitudinal holes of the outer hollow cylinder and strike by air against the ignition nozzle.

According to a preferred embodiment of the present invention, the casing comprises a straight casing section containing the liquefied gas reservoir, and rounded casing section containing the finger-operated piezoelectric generator. The rounded casing section is fitted in an integrally connected to the hollow cylinder section, and a top elongation is integrally connected to the end of the rounded casing section opposite to the side on which it is connected to the straight casing section.

The outer hollow cylinder has, in section, a shape of two parallel lines and two semicircular lines adjoining the parallel lines, and two longitudinal holes are made in each semicircular side surface, whereas the inner hollow cylinder has, in section, a shape of circle, and four longitudinal holes are made at regular intervals. The outer hollow cylinder has an igniting piece triangular-cut and inward bent from one of the flat side surfaces of the cylinder to project through the longitudinal slot of the inner hollow cylinder and extend close to the ignition nozzle.

Thanks to the staggering arrangement of slots and holes in the inner and outer hollow cylinders, air cannot reach the ingition nozzle without flowing over the slot-adjoining parts of the inner hollow cylinder, thereby allowing the entrained dust and impurities, which otherwise would be put on the ignition nozzle, to land on the slot-adjoining parts of the inner hollow cylinder, still assuring the supply of sufficient amount of air to the ignition nozzle.

Other objects and advantages of the present invention will be better understood from the following description of a sole preferred embodiment shown in the accompanying drawings:

PREFERRED EMBODIMENT OF THE INVENTION

Figure 1:
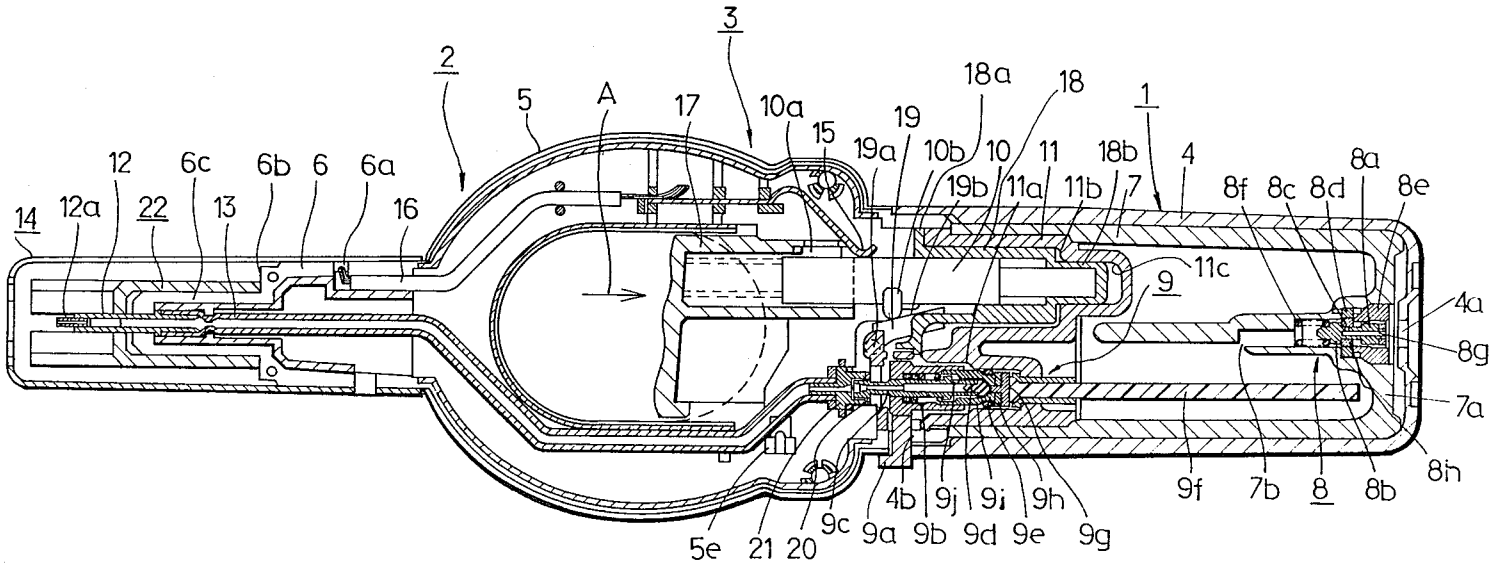
FIG. 1 is a vertical section of a rod-shaped gas igniter according to the present invention.

A rod-shaped gas igniter according to one embodiment of the present invention is described hereinafter as being used to ignite a firework. Referring to FIG. 1, there is shown, in section, a rod-shaped gas igniter. It is shown as comprising a gas reservoir section 1 containg liquefied gas and an ignition mechanism section 2 for igniting the gas supplied to the ignition nozzle. A casing 3 comprises a straight casing section 4 and a rounded casing section 5. A top elongation 6 is integrally connected to the end of the rounded casing section 5. The rounded casing section 5 and the elongation 6 extending therefrom are made in the form of two opposite longitudinal-split counterparts, and these longitudinal-split counterparts are combined, and fitted in the straight casing section 4. FIG. 1 shows one counterpart casing only.

The straight casing section 4 contains a liquefied gas reservoir 7. The reservoir 7 has an inlet valve 8 on its bottom end and an ejection valve 9 on its ceiling end. A piezoelectric generator 10 is partly contained in the straight casing section 4.

As shown, the straight casing section 4 has a liquefied gas inlet hole **4*a* made on its bottom. Also, it has a control ring 9*a* for controlling the gas flow rate from the ejection valve 9, which control ring is rotatable in the slot 4*b* made along the joint at which the straight casing section 4 and the rounded casing section 5** are connected together.

The inlet valve 8 is mounted to the center of the bottom plate **7*a* of the reservoir 7 in alignment with the inlet 4*a* of the reservoir casing 7. The piezoelectric generator 10 is positioned adjacent to the top closure 11 of the reservoir 7**.

The inlet valve 8 comprises a valve stem **8*a* slidably fixed to the center of the bottom 7*a* of the reservoir 7, a valve seat 8*c* on which the expanding head 8*b* of the valve stem 8*a* rests, a control ring 8*d* fitted around the valve seat 8*c*, an annular closure 8*e* fitted around the end of the valve stem and a compressed spring 8f for pushing the expanding head of the valve stem 8a against the valve seat 8c. In loading the reservoir with liquefied gas the valve stem 8a is pushed inward, thereby permitting the liquefied gas to flow into the reservoir 7 through the longitudinal channel 8g and lateral channel 8h of the valve stem 8a and around the expanding head of the valve stem and through the gas inlet 7b**.

The ceiling closure 11 of the reservoir 7 has small and big recesses 11a and 11b. The rear part of ejection valve 9 is fitted in the small recess 11a of the ceiling closure whereas the rear part of the piezoelectric generator mechanism 10 is fitted in the big recess 11b of the ceiling closure with a bracket 11c interventing therebetween.

Figure 6:
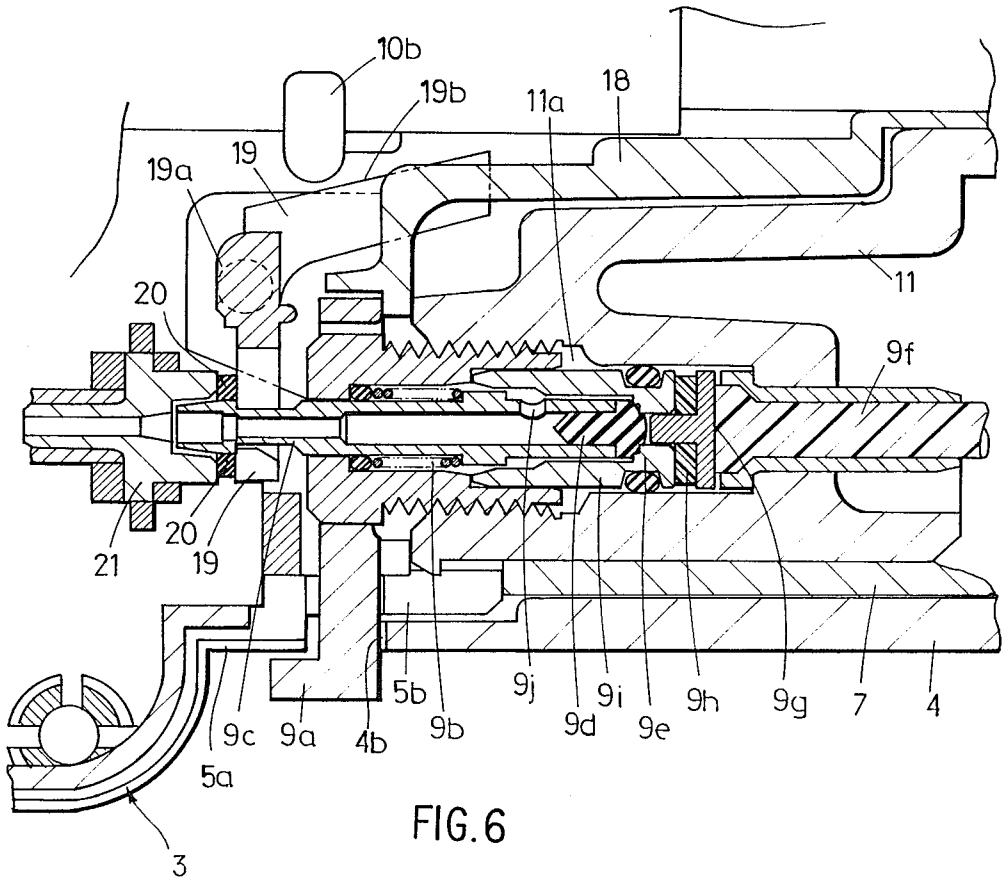
FIG. 6 is an enlarged vertical section showing the ejection valve and associated elements of FIG. 1.

In the ejection valve 9, FIGS. 1 and 6, the nozzle 9c is driven backward under the influence of compressed spring 9b at all times. When the nozzle 9c is driven forward by an operating lever 19 (later described), the valve rubber 9d is moved away from the valve seat 9e, thereby opening the valve. The wick 9f is wet with liquefied gas, and the liquefied gas goes to an apertured filter 9h through the channel (not shown) of a headed article 9g. The liquefied gas stored in the apertured filter 9h flows to the inside of the nozzle 9c through the space between the nozzle bottom 9i and the headed article 9g, the space between the nozzle 9c and the nozzle bottom 9i and the cross channel 9j of the nozzle 9c to eject from the nozzle tip.

A rounded casing section 5 is connected to the straight casing section 4 which contains the liquefied reservoir, and an elongation 6 is integrally connected to and extending from the rounded casing section 5. The rounded casing section 5 contains a conduit 13 connecting the tip end of the ejection valve 9 to the ignition nozzle 12 on one side of the inside of the rounded casing section, and a positive or plus terminal 15 and associated lead conductor 16 connecting the piezoelectric generator 10 to a metal hollow cylinder 14 on the other side of the inside of the rounded casing section 5. An operating cap 17 is fixed to the top of the piezoelectric generator 10, and the cap is slidable in the rounded casing section. The operating cap 17 is spring-biased forward, and when the operating cap 17 is pushed backward, a plus terminal pusher 10a is displaced to enter into contact with the positive terminal 15. When a stopper 18 is operated, the operating cap 17 will be locked.

An operating rod 19 is rotatably fixed about a lever axis 19a which is provided between the ejection nozzle 9 and the piezoelectric mechanism 10. One end of the operating rod 19 is fixed about the head of the nozzle 9c, and the other slant end of the operating rod is positioned to face a lever pusher 10b. Thus, when the operating cap 17 is pushed backward in the direction as indicated by arrow, the ejection nozzle 9c ejects gas.

As shown, the conduit 13 is connected to the tip end of the ejection nozzle 9c via a gasket 20 of an elastomer material and a hollow joint 21 of an electrically conductive material at the rear end of the conduit and to the rear end of the ignition nozzle 12 at the front end of the conduit.

The positive lead conductor 16 is connected to the positive terminal 15 at the rear end of the head, and to the metal hollow housing 14 at the front end of the lead, projecting through an opening 6a made in the elongation 6 of the rounded casing section 5.

The ignition nozzle 12 has an oval shape in section, and is made of a good conductive metal. It has a nozzle tip 12a attached to the part of the nozzle appearing above the elongation 6 of the rounded casing section 5. The nozzle tip 12a is encircled by the inner protecting hollow housing 22 and the outer metal hollow cylinder 14. The nozzle tip 12a has a center channel and longitudinal holes circumferentially spaced (not shown) for gas ejection.

Figure 2:
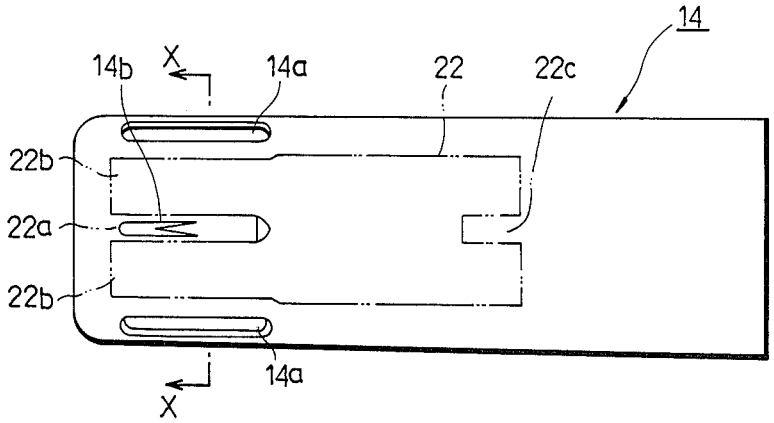
FIG. 2 is a side view showing an outer metal hollow cylinder.
Figure 3:
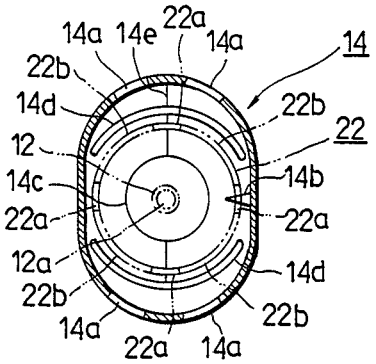
FIG. 3 is a cross section taken along the line "X"—"X" in FIG. 2.

FIG. 2 shows a side view of an outer metal hollow housing 14, and FIG. 3 shows a sectional view taken along the line "X"—"X" in FIG. 2.

The metal hollow housing 14 has four longitudinal ventilation holes 14a circumferentially spaced and an inner projection 14b cut and bent inward. A circular hole 14c is provided at the center of the top plane in alignment with the tip end of the ignition nozzle 12, and arc slots 14d are provided concentric with the circular hole 14c in the top plane of the metal hollow housing 14. The metal hollow housing 14 is made of metal plate, and two longitudinal split counterparts are integrally connected to each other along the lines 14e, and the so combined unit is fitted around the elongation 6 of the rounded casing section 5. Each longitudinal ventilation hole 14a is substantially equal to the length of the ignition nozzle extending from the elongation 6. The longitudinal ventilation holes 14a are made in the semicircular side sections, and a pointed projection 14b is provided in one of the flat side sections.

Figure 4:
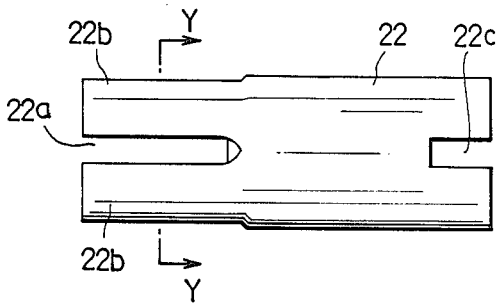
FIG. 4 is a side view showing an inner protecting hollow cylinder.
Figure 5:
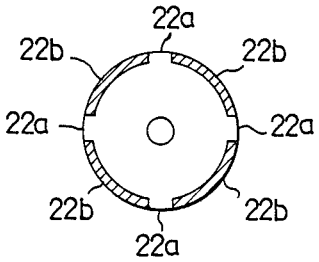
FIG. 5 is a cross section taken along the line "Y'-'—"Y" in FIG. 4.

FIG. 4 shows an inner protecting hollow cylinder, and FIG. 5 shows a sectional view taken along the line "Y"—"Y" in FIG. 4.

The inner protecting hollow cylinder 22, circular in section, is made of a refractory material. It has ventilation slots 22a open on its circular edge. These open slots are made in such a staggering relationship to the ventilation holes 14a of the outer metal hollow housing 14 that the adjoining portions 22b between adjacent ventilation slots 22a may face the ventilation holes 14a the the outer metal hollow housing 14.

The protecting hollow cylinder 22 has two slots 22c on the bottom circumference, and it is fitted around the part of reduced diameter 6c of the elongation 6 to rest on the shoulder 6b of the elongation 6 with projections (not shown) of the elongation inserted in the bottom slots 22c of the protecting hollow cylinder 22.

In use the hollow cylinder casing section 1 is held in hand, and the cap 17 is pushed with finger to displace the lever push 10b and at the same time the positive terminal pusher 10a. Then, the lever pusher 10b pushes the slant surface 19b of the operating lever 19, and at the same time the positive terminal pusher 10a enters into contact with the positive terminal 15. The nozzle 9c of the ejection valve 9 is displaced forward, thereby allowing gas to flow in the hollow joint 21 and the conduit 13 and eject from the slits made in the circumference of the nozzle tip 12a. On the other hand, the voltage generated by the piezoelectric generator 10 is applied to the inner projection 14b of the metal hollow housing 14 through the positive terminal 15 and the positive lead 16 to cause electric discharge or electric arc between the nozzle tip 12a and the inner projection 14b of the metal hollow housing 14, thereby burning gas. Then, air flows through the longitudinal ventilation holes 14a of the outer hollow housing 14 to strike against the slot adjoining portions 22b of the inner hollow cylinder 22, and then the air flows over the surface of the slot adjoining portions 22b, leaving entrained dust and impurities thereon. Finally, the dust-free air flows to the ignition nozzle 12 from the slots 22a of the inner hollow cylinder 22. The ignition nozzle can be used for an extended length of time without clogging by dust and impurities in powder smoke in shooting fireworks.

When the reservoir 7 is filled with liquefied gas, it can be supplied from a liquefied gas container (not shown) by applying the gas container to the inlet valve 8. As a matter of course, an igniter according to the present invention can be equally used to set fire on cigarette, gas appliances and any objects other than fireworks.

I claim:

1. Rod-shaped gas igniter including, in a casing, an ignition nozzle, a finger-operative piezoelectric generator, a liquefied gas reservoir, means responsive to the operation of said piezoelectric generator for opening valve means associated with said liquefied gas reservoir, thereby permitting gas to flow to said ignition nozzle, characterized in that said gas igniter further includes a protective cover having an inner protecting hollow cylinder having longitudinal slots circumferentially spaced around said protecting cylinder for ventilation and enclosing said ignition nozzle and forming a top elongation of said casing, and an outer metal hollow housing having longitudinal holes circumferentially spaced therearound for ventilation and encircling said protecting hollow cylinder, said longitudinal slots of said inner hollow cylinder and said longitudinal holes of said outer hollow housing being staggered to each other, thereby preventing direct invasion by air from said longitudinal holes of said outer hollow housing to said ignition nozzle.

2. Rod-shaped gas igniter according to claim 1, wherein said casing comprises a straight casing section containing said liquefied gas reservoir, and a rounded casing section containing a finger-operative piezoelectric generator and fitted in and integrally connected to said straight casing section, said inner protective cover and said outer hollow housing being integrally connected to the end of said rounded casing section opposite to the end on which said rounded casting is connected to said straight casing section.

3. Rod-shaped gas igniter according to claim 2, wherein said outer hollow housing has, in section, a shape of two parallel lines forming two flat side surfaces and two semicircular lines joining said parallel lines, two longitudinal holes being made in each semicircular side surface, and the inner hollow cylinder has, in section, a shape of a circle with four longitudinal slots at regular intervals through the wall thereof.

4. Rod-shaped gas igniter according to claim 3, wherein said outer hollow housing has an igniting piece triangular-cut and innerward bent from one of said flat side surfaces of said housing projecting through a longitudinal hole of the inner hollow cylinder opposite to the said one of the flat side surfaces of said outer hollow housing.

* * * * *